US007950148B2

(12) United States Patent
Okabe

(10) Patent No.: US 7,950,148 B2
(45) Date of Patent: May 31, 2011

(54) HOLDING SEALER AND EXHAUST GAS PURIFYING DEVICE

(75) Inventor: Takahiko Okabe, Ogaki (JP)

(73) Assignee: Ibiden Co., Ltd., Ogaki-shi (JP)

( * ) Notice: Subject to any disclaimer, the term of this patent is extended or adjusted under 35 U.S.C. 154(b) by 1045 days.

(21) Appl. No.: 11/684,184

(22) Filed: Mar. 9, 2007

(65) Prior Publication Data

US 2007/0212272 A1 Sep. 13, 2007

(30) Foreign Application Priority Data

Mar. 10, 2006 (JP) ..... 2006-066517
Aug. 21, 2006 (JP) ..... 2006-224032

(51) Int. Cl.
*B21D 51/16* (2006.01)
*B01D 50/00* (2006.01)

(52) U.S. Cl. ..... 29/890; 422/179

(58) Field of Classification Search ..... 29/890; 422/168, 178–181, 210; 55/523; 60/299
See application file for complete search history.

(56) References Cited

U.S. PATENT DOCUMENTS

| | | | | | |
|---|---|---|---|---|---|
| 4,578,307 | A * | 3/1986 | Niki et al. | 442/402 |
| 5,098,763 | A * | 3/1992 | Horikawa et al. | 428/116 |
| 5,280,580 | A * | 1/1994 | Brooks et al. | 709/223 |
| 5,290,522 | A * | 3/1994 | Rogers et al. | 422/179 |
| 5,560,757 | A * | 10/1996 | Suzuki et al. | 55/516 |
| 5,862,590 | A * | 1/1999 | Sakashita et al. | 29/890 |
| 5,882,608 | A * | 3/1999 | Sanocki et al. | 422/179 |
| 6,231,818 | B1 * | 5/2001 | TenEyck | 422/179 |
| 6,242,071 | B1 * | 6/2001 | Yamada et al. | 428/116 |
| 6,960,386 | B2 * | 11/2005 | Agata | 428/323 |
| 7,033,412 | B2 * | 4/2006 | Kumar et al. | 55/523 |
| 2002/0127154 | A1 * | 9/2002 | Foster et al. | 422/179 |
| 2003/0049180 | A1 * | 3/2003 | Fukushima | 422/168 |
| 2003/0160350 | A1 * | 8/2003 | Shoji et al. | 264/83 |
| 2004/0057879 | A1 * | 3/2004 | Aizawa et al. | 422/179 |
| 2004/0234428 | A1 * | 11/2004 | Tanahashi et al. | 422/180 |
| 2007/0022747 | A1 * | 2/2007 | Agata | 60/299 |
| 2007/0081926 | A1 | 4/2007 | Okabe | |

FOREIGN PATENT DOCUMENTS

| | | | |
|---|---|---|---|
| EP | 1 326 012 | A2 | 7/2003 |
| JP | 02061313 | A * | 3/1990 |
| JP | 3282362 | | 3/2002 |
| JP | 2002-173875 | | 6/2002 |

* cited by examiner

*Primary Examiner* — David P Bryant
*Assistant Examiner* — Jacob J Cigna
(74) *Attorney, Agent, or Firm* — Oblon, Spivak, McClelland, Maier & Neustadt, L.L.P.

(57) ABSTRACT

A holding sealer for an exhaust gas purifying device includes a sheet member including inorganic fibers and having a first surface and a second surface substantially facing each other and perpendicular to a direction of thickness of the sheet member. At least one of the first and second surfaces has a profile including projecting portions and depressed portions. The projecting and depressed portions of the profile have a maximum difference, h. The h satisfies about 0.4 mm≦h≦9 mm.

3 Claims, 4 Drawing Sheets

HOLDING SEALER AND EXHAUST GAS PURIFYING DEVICE

CROSS-REFERENCE TO RELATED APPLICATIONS

The present application claims priority to Japanese patent applications, No. 2006-066517, filed Mar. 10, 2006, and No. 2006-224032, filed on Aug. 21, 2006. The contents of these applications are incorporated herein by reference in their entirety.

BACKGROUND OF THE INVENTION

1. Field of the Invention

The present invention relates to a holding sealer which includes inorganic fibers and an exhaust gas purifying apparatus using a holding sealer.

2. Discussion of the Background

JP-A 2002-173875 is directed to a heat resistant mat made of alumina fibers and an exhaust gas purifying catalytic converter, and describes that a monolithic catalyst carrier with a holding sealer is press fit into a metal shell by applying a liquid lubricant to the surface of the holding sealer to which the inner wall of the metallic shell makes contact. The contents of JP-A 2002-173875 are hereby incorporated by references.

SUMMARY OF THE INVENTION

According to one aspect of the present invention, a holding sealer for an exhaust gas purifying device includes a sheet member which includes inorganic fibers and has a first surface and a second surface substantially facing each other and perpendicular to a direction of thickness of the sheet member. At least one of the first and second surfaces has a profile including projecting portions and depressed portions. The projecting and depressed portions of the profile have a maximum difference, h. The h satisfies about 0.4 mm≦h≦9 mm.

According to another aspect of the present invention, an exhaust gas purifying device includes an exhaust gas processing body having an outer surface portion, a shell body having an inner surface and housing the exhaust gas processing body, and a holding sealer disposed between the exhaust gas processing body and the shell body. The holding sealer includes a sheet member including inorganic fibers. The sheet member has a first surface and a second surface substantially facing each other and perpendicular to a direction of thickness of the sheet member. The sheet member is positioned such that the first surface of the sheet member is in contact with the inner surface of the shell. At least the first surface has a profile including projecting portions and depressed portions. The projecting portions and depressed portions of the profile have a maximum difference, h, and the h satisfies about 0.4 mm≦h≦9 mm.

According to yet another aspect of the present invention, a method for manufacturing an exhaust gas purifying device includes: providing an exhaust gas processing body having an outer surface portion, a shell body having an inner surface, and a holding sealer, disposing the holding sealer over the exhaust gas processing body, and housing the exhaust gas processing body disposed with the holding sealer into the shell. The holding sealer includes a sheet member including inorganic fibers. The sheet member has a first surface and a second surface substantially facing each other and perpendicular to a direction of thickness of the sheet member. At least the first surface has a profile including projecting portions and depressed portions. The projecting portions and depressed portions of the profile have a maximum difference, h, the h satisfying about 0.4 mm≦h≦9 mm. The holding sealer is disposed over the exhaust gas processing body such that the first surface of the sheet member faces outside and the second surface of the sheet member faces the outer surface portion of the exhaust gas processing body. The exhaust gas processing body disposed with the holding sealer is housed into the shell such that the first surface of the sheet member is in contact with the inner surface of the shell.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
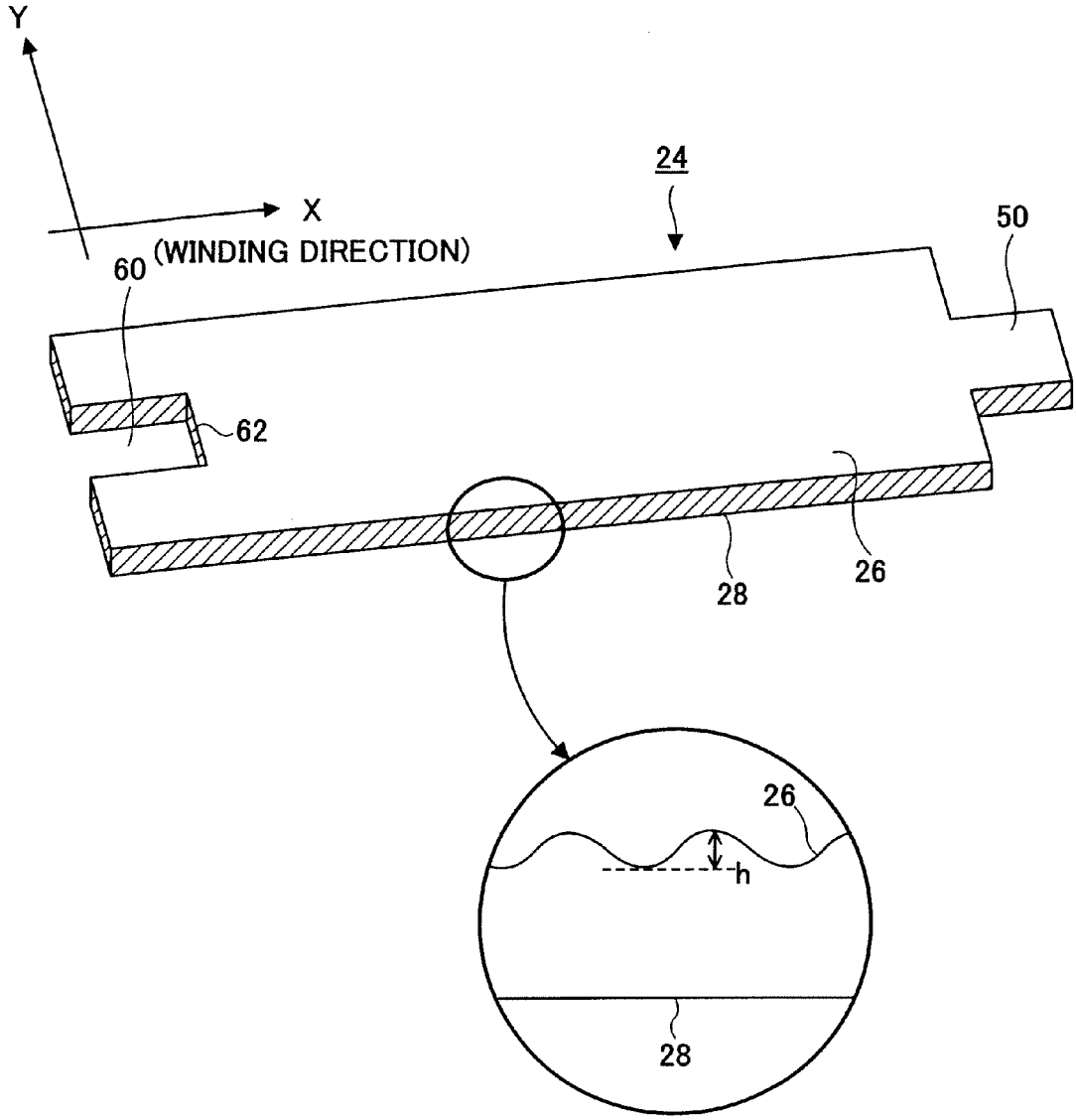
FIG. 1 is an exemplary structure of a sheet member according to one embodiment of the present invention.

The preferred embodiments will now be described with reference to the accompanying drawings, wherein like reference numerals designate corresponding or identical elements throughout the various drawings.

FIG. 1 is an exemplary structure of a sheet member according to one embodiment of the present invention. Referring to FIG. 1, a sheet member 24 contains inorganic fibers and has a first surface 26 and a second surface 28. The first surface 26 and second surface 28 are facing each other and are substantially perpendicular to the direction of thickness of the sheet member 24. As shown in the enlarged view of a cross-section in FIG. 1, at least the first surface 26 of the sheet member 24 is made to have unevenness or a profile having projecting portions and depressed portions, or convex portions and concave portions. The maximum distance (h) between a depressed portion and a projecting portion of the first surface 26 (hereinafter, a "maximum difference (h)") is about 0.4 mm≦h≦9 mm.

When such a first surface 26 of the sheet member 24 is positioned to make contact with another member, the contacting area between the sheet member 24 and the other member is made smaller due to the unevenness formed on the first surface 26, and friction that is generated when the sheet member 24 moves parallel to the other member is reduced. Therefore, the sheet member 24 is easily moved relative to the other member and is positioned in a desired position.

The maximum difference (h) may be preferably in a range of about 3 mm≦h≦7 mm. With such a maximum difference (h), the friction is further reduced. The maximum difference (h) of the first surface 26 of the sheet member 24 is determined as follows. A picture with magnification of twelve times is taken at any position on any cross section of the sheet member 24, and in the first surface 26 in the picture, the distance between the lowest point of the depressed portions and the highest peak of the projecting portions of the sheet member 24 is determined. Next, the same measurements are performed for cross-sectional pictures taken at nine other positions of the sheet member 24, and an average value of measurements at the ten positions is defined as the maximum difference (h) of the first surface 26. The terms "the first surface" and "the second surface" are used for describing the embodiments and both surfaces of the sheet member 24 may have the maximum difference (h) of about 0.4 mm≦h≦9 mm, as "the first surface."

Figure 2:
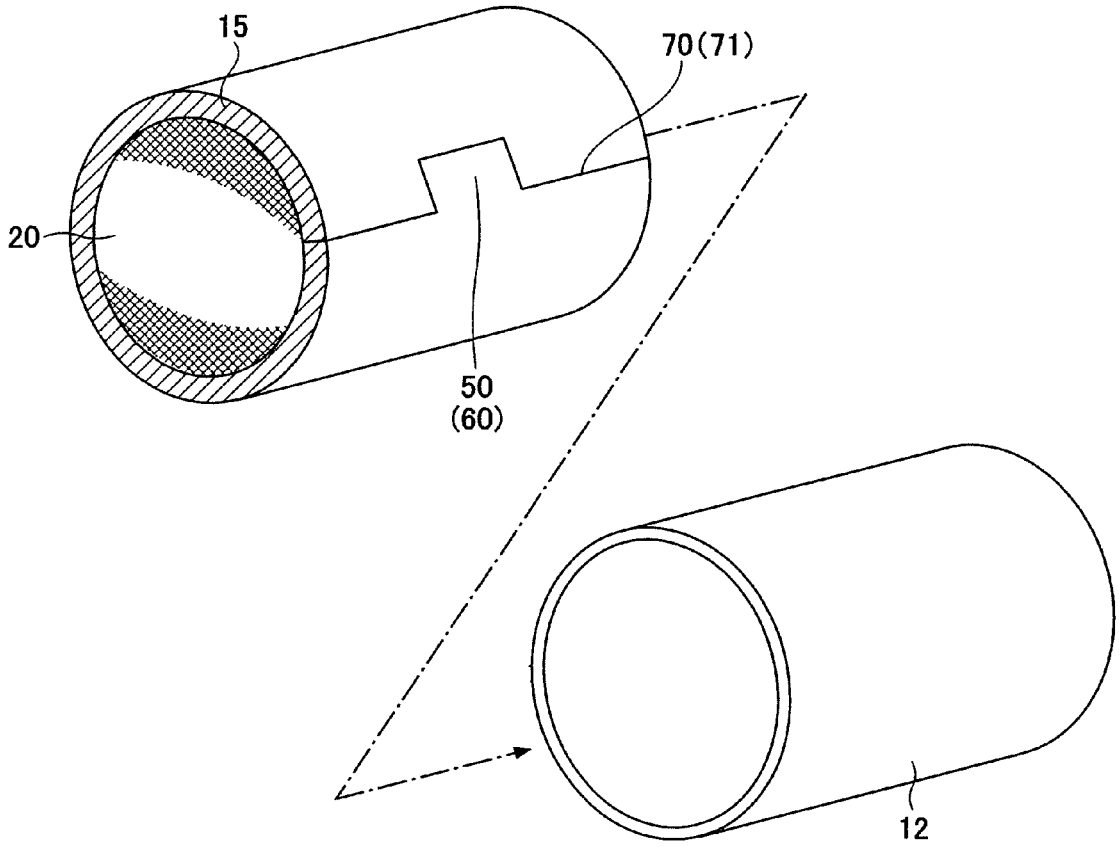
FIG. 2 is an exhaust gas processing device in which a sheet member according to one embodiment of the present invention is used as a holding sealer.

FIG. 2 is an exhaust gas processing device in which a sheet member according to one embodiment of the present invention is used as a holding sealer. Referring to FIG. 2, the sheet member 24 in FIG. 1 is used as a holding sealer 15 of an exhaust gas processing body 20. The holding sealer 15 is wrapped around the outer surface of the exhaust gas processing body 20, e.g., a catalyst carrier, having a cylindrical shape. The holding sealer 15 has a projection 50 and a recess 60 for fitting. The projection 50 and the recess 60 are formed at edges 70, 71 which extend perpendicular to the wrapping direction (the X direction shown in FIG. 1). When the holding sealer 15 is wrapped around the exhaust gas processing body 20, the projection 50 ("projecting edge portion") and the recess 60 ("recessed edge portion") are fitted together as shown in FIG. 2, and the holding sealer 15 is fixed onto the exhaust gas processing body 20, the first surface 26 of the sheet member 24 (shown in FIG. 1) facing outside. Then, the exhaust gas processing body 20 with the holding sealer 15 is press fitted into a cylindrical metallic shell 12 having the inner diameter somewhat larger than the outer diameter of the exhaust gas processing body 20.

To fix the exhaust gas processing body 20 with the holding sealer 15 at a predetermined position within the metallic shell 12, the inner diameter of the metallic shell 12 may be slightly smaller than the outer diameter of the exhaust gas processing body 20 with the holding sealer 15. Then, when the exhaust gas processing body 20 with the holding sealer 15 is press fitted into the metallic shell 12, a shearing force is exerted on the outer surface of the holding sealer 15 due to the friction against the inner wall of the metallic shell 12. Thus, the position of the holding sealer 15 may be shifted or deviated from the predetermined position during the press fitting, or a gap may be formed between the metallic shell 12 and the holding sealer 15. However, by using the sheet member 24 as the holding sealer 15, the first surface 26 makes contact with the inner wall of the metallic shell 12, and friction during the press fitting is reduced. Thus, the exhaust gas processing body 20 with the holding sealer 15 is placed within the metallic shell 12 more easily, and undesired shifting and gaps can be suppressed.

Figure 3:
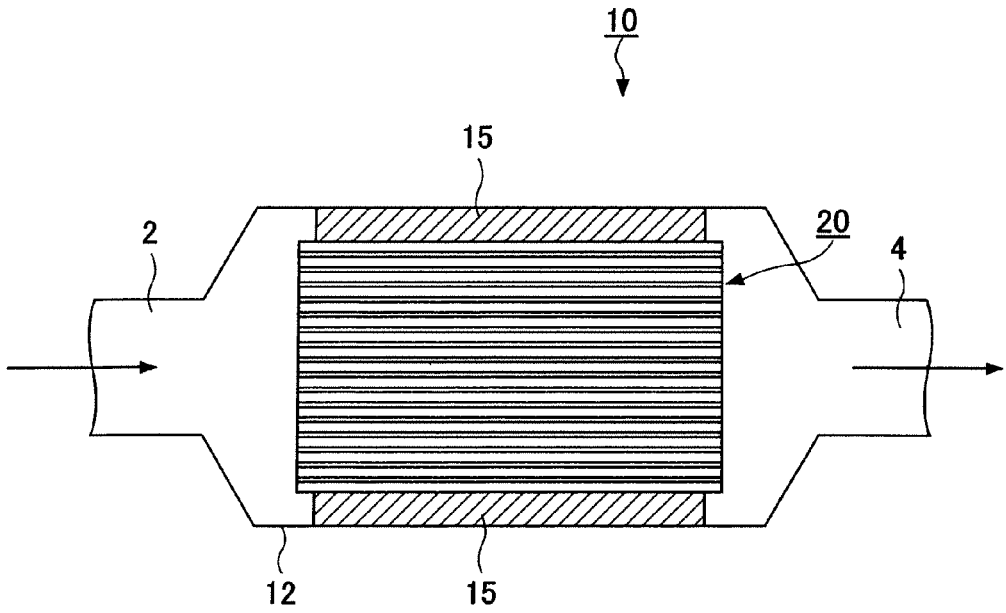
FIG. 3 is an exemplary exhaust gas purifying device according to one embodiment of the present invention.

FIG. 3 is an exemplary exhaust gas purifying device according to one embodiment of the present invention. Referring to FIG. 3, an exhaust gas processing body 20 is shown as a catalyst carrier having many through-holes extending in directions parallel to gas flow. An exhaust gas purifying device 10 shown in FIG. 3 is one example and is not limited to such a structure. For example, the exhaust gas processing body 20 may be a DPF (Diesel Particulate Filter) in which some of the through-holes are sealed. By using the sheet member 24 shown in FIG. 1 as the holding sealer 15, the sealing of gas in the exhaust gas processing body 20 and the holding ability of the exhaust gas processing body 20 can be improved.

According to one embodiment of the present invention, the sheet member 24 may be manufactured by processes described below. First, a laminated sheet containing inorganic fibers is manufactured. In the descriptions below, a mixture of alumina and silica is used as inorganic fibers, but inorganic fibers are not limited to such a mixture. For example, either alumina or silica alone may be used. Silica sol is added to a basic aluminum chloride solution whose aluminum content is about 70 g/l and atomic ratio of Al/Cl is 1.8 such that the composition ratio of alumina and silica (alumina: silica) is adjusted to be about 60-80:40-20, thereby obtaining a precursor of inorganic fibers. Preferably, the composition ratio of alumina and silica may be about 70-74:30-26. If the alumina is below about 60%, the composition ratio of mullite produced from alumina and silica becomes low, and a finished sheet member has a higher thermal conductivity and insulation of heat becomes insufficient.

Next, organic polymers such as polyvinyl alcohols are added to the precursor of alumina fibers. Then, by condensing the resulting liquid, a spinning solution is prepared. The spinning solution is spun with a blowing method.

In the blowing method, spinning is carried out by an air flow blowing from an air nozzle and a flow of the spinning solution pushed out from a supply nozzle for the spinning solution. A gas flow speed per slit from the air nozzle is usually about 40-200 m/s. The diameter of a spinning nozzle is usually about 0.1-0.5 mm, and the amount of solution per one supply nozzle of the spinning solution is usually about 1-120 ml/h, preferably about 3-50 ml/h. Under such conditions, the spinning solution pushed out from a supply nozzle of the spinning solution does not become spray or mist but stretches sufficiently, and the fibers hardly bond with each other. Thus, by optimizing the spinning conditions, a precursor of alumina fibers having a narrower diameter distribution can be obtained.

The average length of alumina fibers manufactured is preferably equal to or longer than about 250 μm, more preferably equal to or longer than about 500 μm. If the average length of fibers is less than about 250 μm, the fibers do not sufficiently intertwine each other and sufficient strength is not obtained. The average diameter of inorganic fibers is not particularly limited; however, according to the embodiments of the present invention, the average diameter of inorganic fibers is equal to or greater than about 5 μm, for example, 7 μm. In the sheet members according to the embodiments of the present invention, the average diameter of the inorganic fibers may be equal to or greater than about 6 μm. As the average diameter of the inorganic fiber increases, the handling ability of the sheet member decreases because the flexibility of the sheet member tends to decrease. However, in the sheet member according the embodiment of the present invention, even if the sheet member has the average diameter of the inorganic fibers that is more than 6-7 μm, the sheet member can be easily moved and handled against the other member due to the above-mentioned effect against friction.

A laminated sheet is manufactured by laminating the precursor for which spinning is completed. Then, a needling process is performed on the laminated sheet. The needling process is where needles are pierced though the laminated sheet, thereby thinning the laminated sheet and restricting the bulkiness of the sheet member. The needling process is carried out by a needling machine having a needle board capable of moving back and forth along a piercing direction of needles and two support plates provided one on each side of the laminated sheet. On the needle board, many needles, for example, about 100-5000 needles/100 $cm^2$, for piercing the laminated sheet are arranged. Through-holes for the needles are provided on the support plates. Therefore, the needling process is performed by holding the laminated sheet between the support plates and piercing the needles through the laminated sheet, thereby orienting the fibers randomly intertwined each other to a laminating direction and reinforcing the strength of the laminated sheet in the laminating direction. Also, with the needling machine, the unevenness of the surface of the laminated sheet may be controlled by adjusting the number of times the needle board is pressed against the laminated sheet (that is, the number of times for piercing the needles through the laminated sheet). Therefore, through the needling process, the unevenness of the first surface of the sheet member may be controlled within the range set forth according to the embodiments of the present invention.

The unevenness of the first surface of the sheet member may also be controlled by a heat compression drying method described below. By heating the laminated sheet subjected to the needling process from an ambient temperature and continuously firing at a temperature of as high as about 1250° C., the sheet member 24 having a predetermined weight can be obtained. For easier handling, the sheet member which is obtained through the above processes is cut into a predetermined size.

Preferably, the sheet member is impregnated with an organic binder such as a resin after the cutting. Thereby, the bulkiness of the sheet member can be adjusted, and the scattering and separation of the inorganic fibers during cutting and processing of the sheet member can be reduced or prevented. Also, the handling of the sheet member can be improved, and for example, when the sheet member is used as a holding sealer for an exhaust gas purifying device, the holding sealer prevents decrease in its ability to hold which is caused by the separation of the inorganic fibers. Moreover, when a high temperature exhaust gas is introduced into an exhaust gas purifying device in operation, an organic binder impregnated in the holding sealer is lost by heat, and the holding sealer which has been compressed is restored to its original state, thereby sealing any slight gaps between the metallic shell and the exhaust gas processing body and improving the holding and sealing abilities of the holding sealer.

The content of an organic binder is preferably between 1.0 and 10.0 weight %. If the content is less than about 1.0 weight %, the separation of the inorganic fibers is not sufficiently prevented. Also, if the content is greater than about 10.0 weight %, the sheet member becomes inflexible and it makes difficult to wrap the sheet member around the exhaust gas processing body.

For the organic binder, an epoxy resin, an acrylic resin, a rubber-type resin or a styrene resin, preferably, for example, an acrylic resin (ACM), acrylnitryl-butadiene rubber (NBR), or a styrene-butadiene rubber (SBR), may be used. A resin may be impregnated into the sheet member by a flow-coater method using an aqueous dispersion prepared with such an organic binder and water. Any excess coated solid and water in the sheet member are removed in the following step.

Excess solid is removed and a drying process is performed as follows. Excess solid may be removed by suction, and excess water is removed by a heat compression drying method. In this method, because a pressing pressure is applied to the sheet member, the excess water can be removed and also the sheet member can be made thinner. The drying process is performed at a temperature of around 95-155° C. If the temperature is lower than about 95° C., the drying takes longer and production becomes inefficient. Also, if the drying temperature is higher than 155° C., an organic binder begins to decompose and lose its adhesiveness. The unevenness of the first surface of the sheet member may be controlled during this process. For example, for the heat compression drying treatment, a press mold which makes contact with a surface of the sheet member may be provided with a surface having a predetermined uneven profile (projecting portions and depressed portions), thereby achieving a desired maximum difference (h) on the surface of the sheet member.

Finally, the sheet member is cut to a predetermined shape, for example, the shape shown in FIG. 1.

The sheet member 24 obtained through the foregoing processes may be used as the holding sealer 15 of the exhaust gas processing body 20 in the exhaust gas purifying device 10 as shown in FIG. 2. In such a case, the holding sealer 15 is wrapped around the exhaust gas processing body 20, the first surface 26 of the sheet member 24 facing outside, and the projection 50 and the recess 60 for fitting at the edges 70, 71 are fitted and fixed. When the exhaust gas processing body 20 with the holding sealer 15 in that state is put into the metallic shell 12 made of, for example, stainless steel, friction between the inner wall of the metallic shell 12 and the surface of the holding sealer 15 becomes small due to the aforementioned effect. As a result, the exhaust gas processing body 20 with the holding sealer 15 is easily installed within the metallic shell 12, and shifting or dislocation of the holding sealer 15 can be prevented. Therefore, the exhaust gas purifying device 10 with good sealing ability is manufactured.

EXAMPLES

The sheet member is manufactured by the following procedures.

Manufacturing of the Sheet Member

Silica sol is blended to a basic aluminum chloride solution whose aluminum content is 70 g/l and atomic ratio is Al/Cl=1.8 such that the composition ratio of alumina and silica (alumina:silica) is adjusted to be $Al_2O_3$:$SiO_2$=72:28, thereby obtaining a precursor of alumina fibers.

Next, an organic copolymer such as polyvinyl alcohols is added to the precursor of alumina fibers. Then, by condensing the resulting liquid, a spinning solution is prepared. The spinning solution is spun with a blowing method.

Then, the spun precursor of alumina fibers is folded and laminated, thus obtaining a laminated sheet of alumina fibers. A needling process is performed on the laminated sheet with repeated pressing contacts of a needle board having 80 needles/100 $cm^2$. After the needling process, about 14.7 per $cm^2$ of needle processing traces are found on the first surface of the sheet. After that, the obtained sheet member is subjected to continuous heating from an ambient temperature to a temperature of as high as 1250° C., thus obtaining a sheet member of alumina fibers having 1160 $g/m^2$ of weight. The average diameter of alumina fibers is 5.0 μm and the minimum diameter is 3.2 μm. The thickness of the sheet member is 9 mm.

The average diameter of fibers is measured as follows. First, the alumina fibers are put into a cylinder and crushed by applying a pressure of 20.6 MPa. Then, the resulting samples are put on a screen, and ones passed through the screen are used for electron microscopic observation. After vapor-depositing gold on the surfaces of the samples, an electron microscopic picture with magnification of almost 1,500 times is taken. From the obtained picture, the diameter of a fiber is measured for at least 40 fibers. This step is repeated for five samples and the average of measured values is used as the average diameter of fibers.

Shearing of the Sheet Member

The sheet member manufactured based on the above processes is cut into a size of 1270 mm vertical length and 1280 mm horizontal length.

Impregnation of an Organic Binder

The cut sheet member is impregnated with an organic binder (acryl latex). An acryl resin aqueous dispersion (Nippon Zeon: LX803; solid concentration 50±10%, pH 5.5-7.0) is adjusted so as to obtain 1.0-10.0 wt % of resin concentration, thus obtaining an impregnating fluid. Then, the impregnating fluid is impregnated into the sheet member by a flow coater method.

Suction of Solid

The sheet member after impregnating the binder has solid in excess of a predetermined amount adhered thereto, and thus the excess solid is removed by a suction process for about 3 seconds. After this process, it is confirmed by a weighing method that an impregnated ratio of the organic binder of the sheet is 4 wt %.

Heat Compression Drying Method

After the suction process, the sheet member is subjected to a heat compression drying treatment performed at a drying temperature of 95-155° C. The sheet member is fixed from its top and bottom by jigs and is subjected to the heat compression drying treatment. After the treatment, the sheet member having an average thickness of about 8 mm is obtained. The sheet member obtained via the above processes is Example 1 below.

Next, the number of times a sheet member makes press contact with the needling board during the needling process is changed so as to produce needle processing traces of 2.3/cm$^2$-9.8/cm$^2$ on the first surface of a sheet member, thereby manufacturing the sheet members of Examples 2-6. Except for the foregoing process, the same processes as in Example 1 are followed. Also, the sheet members of Comparative Examples 1-3 are manufactured using the same processes as in Example 1, except that the needle processing traces on the main surfaces of the sheet members are adjusted to be 1.0/cm$^2$, 19.6/cm$^2$ and 24.3/cm$^2$.

Table 1 below shows the maximum differences (h) of the first surfaces of the sheet members, Examples 1-6 and Comparative Examples 1-3, manufactured as such. The first surface is defined as one having a larger maximum difference (h) among the two surfaces of each sheet member.

TABLE 1

| | Average fiber diameter (μm) | The number of needle processing traces (number/cm$^2$) | Maximum difference (h) | Friction (N) | Coefficient of friction | Results of press-fitting examination |
|---|---|---|---|---|---|---|
| Example 1 | 5.0 | 14.7 | 0.89 | 12<br>11.9 (X) | 0.24<br>1.24 (X) | good |
| Example 2 | 5.0 | 2.3 | 8.80 | 11.8 | 0.24 | good |
| Example 3 | 5.0 | 3.2 | 7.94 | 10.3 | 0.21 | good |
| Example 4 | 5.0 | 5.6 | 6.02 | 9.3 | 0.19 | good |
| Example 5 | 5.0 | 6.4 | 3.94 | 9.8 | 0.20 | good |
| Example 6 | 5.0 | 9.8 | 2.55 | 10.8<br>10.9 (X) | 0.22<br>0.22 (X) | good |
| Comparative Example 1 | 5.0 | 1.0 | 9.70 | 13.2 | 0.27 | much surface damages |
| Comparative Example 2 | 5.0 | 19.6 | 0.21 | 12.9<br>12.9 (X) | 0.26<br>0.26 (X) | much surface damages |
| Comparative Example 3 | 5.0 | 24.3 | 0.10 | 13.1 | 0.27 | much surface damages |
| Example 7 | 7.2 | 1.9 | 8.70 | 11.3 | 0.23 | good |
| Example 8 | 7.2 | 2.8 | 8.19 | 9.8 | 0.20 | good |
| Example 9 | 7.2 | 5.2 | 6.12 | 8.8 | 0.18 | good |
| Example 10 | 7.2 | 6.9 | 3.81 | 9.3 | 0.19 | good |
| Example 11 | 7.2 | 10.6 | 1.96 | 10.5 | 0.21 | good |
| Example 12 | 7.2 | 15.4 | 0.92 | 11.2 | 0.23 | good |
| Comparative Example 4 | 7.2 | 0.9 | 9.50 | 13.2 | 0.27 | much surface damages |
| Comparative Example 5 | 7.2 | 20.3 | 0.32 | 12.5 | 0.25 | much surface damages |
| Comparative Example 6 | 7.2 | 25.1 | 0.10 | 12.6 | 0.26 | much surface damages |

Also, the number of times a sheet member makes pressing contact with the needling board during the needling process is changed so as to produce needle processing traces 1.9/cm$^2$-15.4/cm$^2$ on the first surfaces of the sheet members, thereby producing the sheet members of Examples 7-12 having 7.2 μm average diameter of alumina fibers. Except for the foregoing process, the same processes as in Example 1 are followed. Moreover, the sheet members of Comparative Examples 4-6 having 7.2 μm average diameter of alumina fibers are manufactured using the same processes as in Example 1, except that the number of needle processing traces on the first surfaces of the sheet members are adjusted to be 0.9/cm$^2$, 20.3/cm$^2$ and 25.1/cm$^2$. Table 1 shows each of the maximum differences (h) of the first surfaces of these sheet members. The first surface of the sheet member is defined as one having a larger maximum difference (h) among the two surfaces of each sheet member.

As shown in Table 1, various sheet members, in which the maximum differences (h) of the first surfaces are different, are provided by changing the number of needle processing traces occurring due to the needling process.

Then, the following evaluation examinations are performed using samples which are cut from the obtained sheet members.

Evaluation Examinations of Friction

Figure 4:
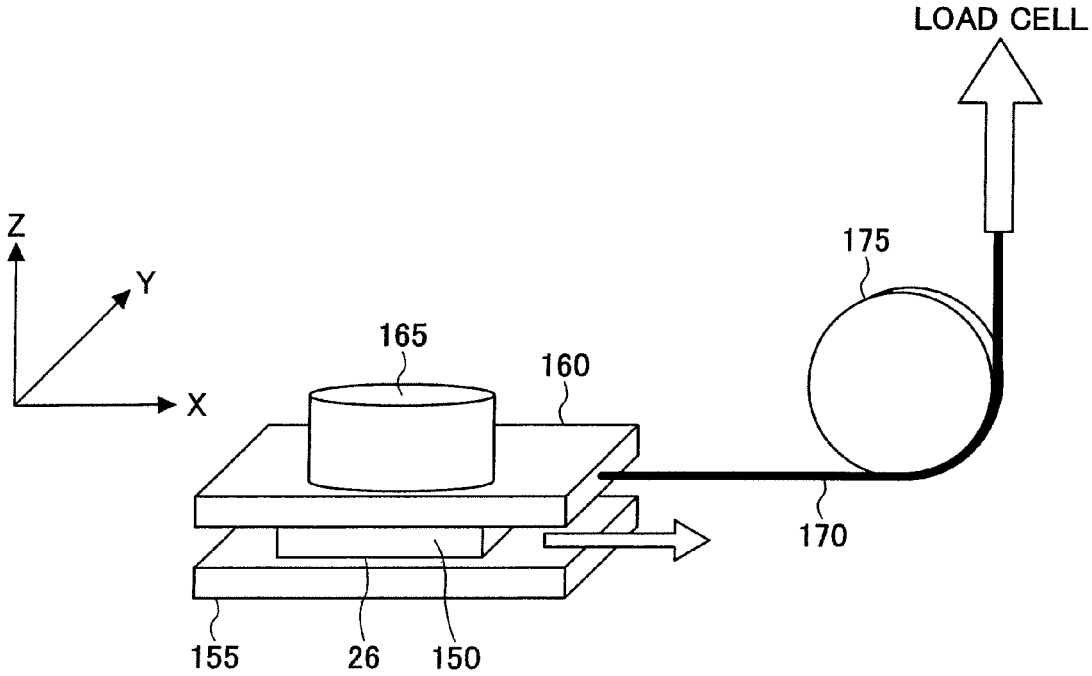
FIG. 4 is a schematic view of an apparatus for evaluating friction.

For evaluation examinations of friction, samples which are cut to 30×50 mm from each sheet member manufactured in the foregoing processes are used. In these examinations, a universal test machine provided with a load cell (manufactured by Instron) is used. A scheme of the examinations is shown in FIG. 4. A sheet member sample 150 as the sample is placed on a stainless plate 155 such that X direction of FIG. 4 becomes a longitudinal direction of the sample 150. The sample 150 is placed its first surface 26 contacting the stainless plate 155 below. Then, a load support plate 160 having a larger size (for example, 150 mm long in the X direction and 50 mm long in the Y direction) than the size of the sample 150 is placed on the sample 150 horizontally, and a weight 165 is placed on the load support plate 160. The total load of the load support plate 160 and the weight 165 is 5 kg. The upper surface of the sample 150 and an interface of the load support plate 160 making contact with the upper surface of the sample 150 are fixed with adhesive, and so they do not move independently. The load support plate 160 is connected to the load cell of the universal test machine via a wire 170, and the wire 170 is set through a pulley 175 such that a movement in the vertical direction of the load cell (Z direction in FIG. 4) is transmitted as a movement in the horizontal direction (X direction) with respect to the load support plate 160. That is, when the load cell is moved to the upper part of FIG. 4, this movement is transmitted to the load support plate 160 through the wire 170 and the pulley, then the load support plate 160 and the sample 150 fixed to the load support plate 160 are subjected to a force in the horizontal direction moving to the right. Therefore, in this device, friction occurring when the sample 155 is moved against the stainless plate 155 below with shearing force can be measured.

Using the above device, the load support plate 160 is pulled at 10 mm/min in the horizontal, and after the sample 150 has started to move, and an indicating value of the load cell has stabled, the load value is measured. The obtained load value is defined as friction, and the coefficient of friction is obtained by dividing the load value with the load (5 kg) on the sample 150.

In Table 1, the results of the coefficient of friction which are obtained for each sheet member are shown. In Table 1, two values for the coefficient of friction are shown for Examples 1 and 6 and Comparative Example 2. Among these, the results of the coefficient of friction indicated in (X) are values when placing the sample 150 such that the direction of needle processing traces formed on the sample 150 is perpendicular to the pulling direction. The other results of the coefficient of friction are values when the sample 150 is placed such that the direction of needle processing traces formed on the sample 150 is aligned with the pulling direction. However, comparing the respective results for both placements of Examples 1 and 6 and Comparative Example 2, a relationship between the direction of needle processing traces formed on the sample 150 and the pulling direction does not show significant influence on measurement results of the coefficient of friction.

Figure 5:
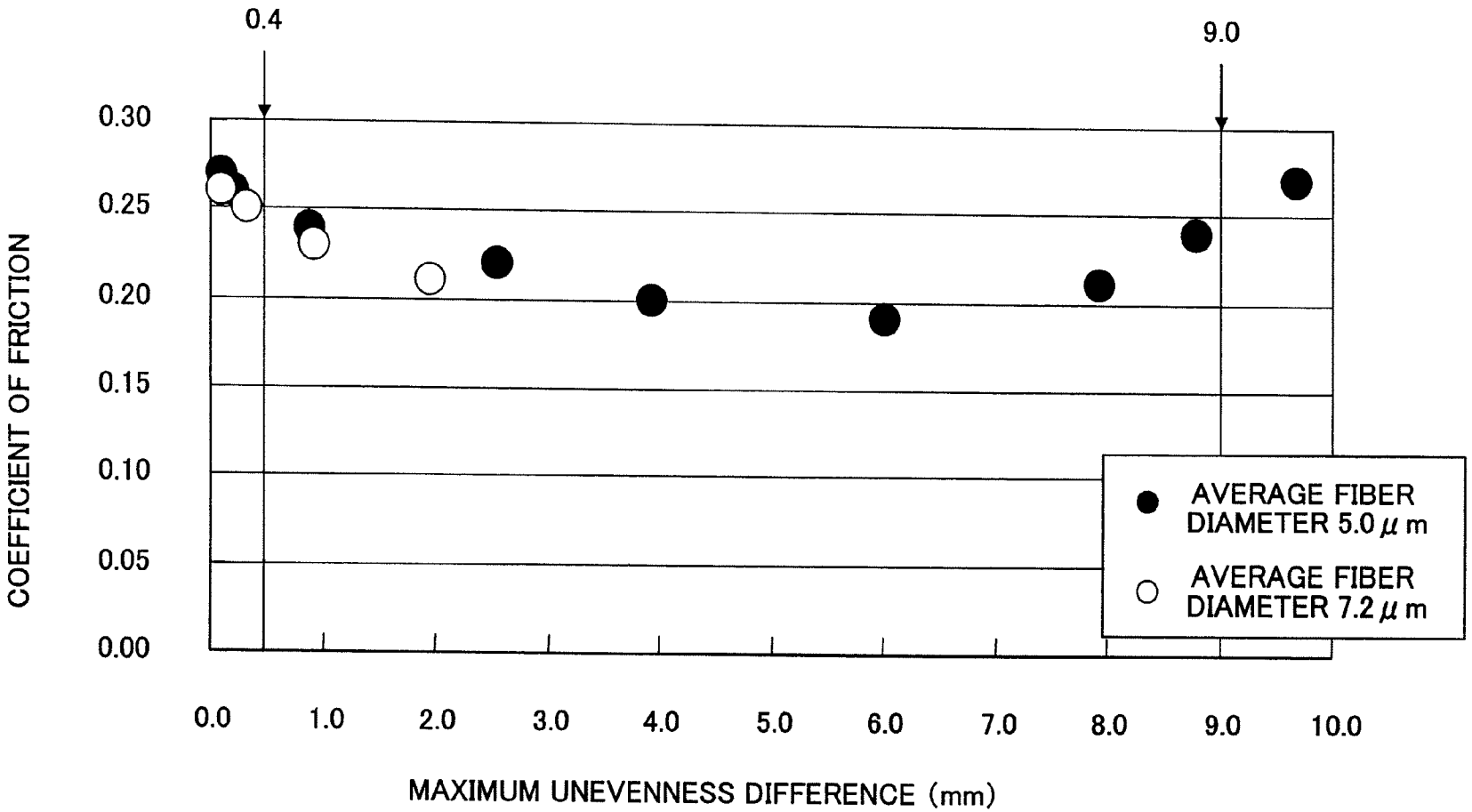
FIG. 5 is a graph showing a relationship between unevenness differences of the first surface and coefficients of friction.

FIG. 5 is a graph indicating the results in Table 1. The horizontal axis in FIG. 5 is the maximum difference (h) of the first surface of the sheet member, and the vertical axis in FIG. 5 is the coefficient of friction. According to FIG. 5, when the maximum difference (h) is 0.4 mm≦h≦9 mm, the coefficient of friction is about 0.18-0.24. Also, in the sheet member used generally as a holding sealer for an exhaust gas purifying device, the number of needle processing traces is usually about $20/cm^2$-$25/cm^2$. In this case, it is predicted that the maximum difference (h) is about 0<h≦0.3 mm based on Table 1, and the coefficients of friction for such sheet members are calculated to be about 0.25-0.27 based on the results of Comparative Examples 2, 3, 5 and 6 in Table 1. Therefore, by setting the maximum difference (h) of the first surface to be between 0.4 mm≦h≦9 mm, a sheet member experience less friction during the installation of the sheet member into an metallic shell of an exhaust gas purifying device, than a conventional sheet member.

Also, as the average diameter of inorganic fibers included in a sheet member is made larger, the coefficient of friction becomes somewhat smaller even if the maximum difference (h) remains the same. It is predicted that when the average diameter of inorganic fibers becomes larger, the number of fibers existing in the projecting portions of the first surface is relatively reduced, thus a resistance against friction in the shearing direction is reduced.

Also, when the maximum difference (h) is greater than a certain value, for example, about 6 mm, the coefficient of friction tends to increase. It is predicted that because a sheet member having a larger maximum difference (h) on the first surface is manufactured with fewer pressing contacts by the needling board during the needling process, the sheet member is compressed insufficiently, and the projecting portions of the first surface are crushed by contacting against another member, e.g., a stainless sheet, thus resulting in increase in its contacting area. Hence, it is preferable that the maximum difference (h) of the projecting portions and depressed portions formed on the first surface of the sheet member is set to satisfy 3 mm≦h≦7 mm.

Evaluation Examinations of Press-Fitting

Each of the sheet members manufactured in the foregoing processes is used as a holding sealer, then after these sheet members are wrapped around cylindrical catalyst carriers and assembled as units, the units are pressed into cylindrical metallic shells and catalyst converters are manufactured. The sheet members are placed, their first surfaces facing outside, that is, the first surfaces of the sheet members make contact with the inner surfaces of the metallic shells. The distances between the catalyst carriers and the metallic shells are about 3.5 mm. Next, the catalyst converters are cut in a vertical direction orthogonal to their cylindrical axis, and the surfaces of the holding sealers making contact with the inner surfaces of the metallic shells are observed.

Results from each sheet member are shown in Table 1. When the sheet members of Examples 1-12 are used, no damages to the surfaces of the sheet members after examination are found and they are in good condition. On the other hand, when the sheet members of Comparative Examples 1-6 are used, damages such as peel offs on the surfaces of the sheet members are found.

The holding sealer and the exhaust gas purifying device according to the foregoing embodiments of the present invention are applicable to an exhaust gas purifying device for vehicles.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for manufacturing a sheet member of a catalytic converter, the method comprising:

preparing a laminated sheet by laminating precursors containing inorganic fibers, the laminated sheet having a first surface and a second surface opposite to each other and substantially perpendicular to a direction of thickness of the laminated sheet;

forming unevenness, containing projecting portions and depressed portions, on at least the first surface of said laminated sheet;

firing the laminated sheet to form said sheet member;

impregnating an organic binder into said sheet member; and applying a heat compression drying treatment to said sheet member while pressing a press mold having a contact surface provided with a predetermined uneven profile so that the projection portions and the depressed portions of the unevenness of said sheet member have a maximum height difference, h, wherein h satisfies the relationship of about 0.4 mm≦h≦9mm.

2. A method for manufacturing a sheet member of a catalytic converter, the method comprising:

preparing a laminated sheet by laminating precursors containing inorganic fibers, the laminated sheet having a first surface and a second surface, the first and second surfaces being opposite to each other and each being substantially perpendicular to a direction of thickness of the laminated sheet;

forming unevenness, containing projecting portions and depressed portions, on at least the first surface of said laminated sheet by a needling process; and firing the laminated sheet to form said sheet member so that the projection portions and the depressed portions of the unevenness of said sheet member have a maximum height difference h, wherein h satisfies the relationship of about 0.4 mm≦h≦9 mm.

3. The method for manufacturing a sheet member according to claim 2, wherein the forming unevenness includes forming needle processing traces of $2.3/cm^2$-$9.8/cm^2$ on the sheet member through the needling process.

* * * * *